US007411122B2

(12) United States Patent
Yamaguchi

(10) Patent No.: US 7,411,122 B2
(45) Date of Patent: Aug. 12, 2008

(54) KEYBOARD DEVICE FOR KEYBOARD MUSICAL INSTRUMENT

(75) Inventor: Tsutomu Yamaguchi, Shizuoka-ken (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 0 days.

(21) Appl. No.: 10/663,748

(22) Filed: Sep. 17, 2003

(65) Prior Publication Data

US 2004/0065186 A1 Apr. 8, 2004

(30) Foreign Application Priority Data

Sep. 27, 2002 (JP) ..... 2002/283778

(51) Int. Cl.
*G10C 3/12* (2006.01)

(52) U.S. Cl. ..... 84/423 R; 84/430

(58) Field of Classification Search ..... 84/423 R, 84/433, 430
See application file for complete search history.

(56) References Cited

U.S. PATENT DOCUMENTS 3,120,146 A * 2/1964 Stiles ..... 84/433
4,128,035 A * 12/1978 Erickson et al. ..... 84/433
5,066,842 A * 11/1991 Yamagata et al. ..... 200/345
5,824,928 A * 10/1998 Kumano et al. ..... 84/423 R
6,051,768 A * 4/2000 Masubuchi ..... 84/433

FOREIGN PATENT DOCUMENTS

| | | |
|---|---|---|
| JP | 06-250642 | 9/1994 |
| JP | 09-244656 | 9/1997 |
| JP | 2001175244 | 6/2001 |

* cited by examiner

*Primary Examiner*—Lincoln Donovan
*Assistant Examiner*—Jianchun Qin
(74) *Attorney, Agent, or Firm*—Crowell & Moring LLP

(57) ABSTRACT

There is provided a keyboard device for a keyboard musical instrument, which is capable of enhancing the key touch feeling sensed when each key is depressed, and durability of stoppers. Keys each open downward, and have side walls and an abutment portion provided inside the side walls. The abutment portion has a lower end located at approximately the same height as lower ends of the side walls. The keys each perform downward pivotal motion when depressed. Stoppers are arranged under the keys in a manner associated therewith, respectively, for abutment of the side walls and the abutment portion of the associated key thereagainst, for stopping downward pivotal motion thereof. The stoppers have a shock-absorbing property.

2 Claims, 6 Drawing Sheets

PRIOR ART

PRIOR ART

KEYBOARD DEVICE FOR KEYBOARD MUSICAL INSTRUMENT

BACKGROUND OF THE INVENTION

1. Field of the Invention

This invention relates to a keyboard device for a keyboard musical instrument, such as an electronic piano.

2. Prior Art

Conventionally, this kind of keyboard device has been proposed e.g. in Japanese Laid-Open Patent Publication (Kokai) No. 2001-175244. Further, an example of another conventional keyboard device for an electronic piano is shown in FIG. 6. In this keyboard device 40, a plurality of keys 3 have rear ends pivotally supported by key fulcrums 5 provided on a chassis 2. The keys 3 are formed by synthetic resin molded articles and comprised of white keys 3*a* (only one of which is shown) and black keys 3*b* (only one of which is shown). The keys 3 each have a top wall 3*c*, and left and right side walls 3*d*, 3*d* (only one of which is shown), and a front wall 3*e*. The keys 3 are open downward. Further, each key 3 has L-shaped engaging portions 3*f*, 3*f* (only one of which is shown) extending downward from the respective left and right side walls 3*d*, 3*d*. Disposed between the rear end of the key 3 and the chassis 2 is a spring 12 for biasing the key 3 in the key-releasing direction (in the clockwise direction, as viewed in FIG. 6).

On the chassis 2, under respective front ends of the keys 3, there are mounted upper limit stoppers 6*a* and lower limit stoppers 6*b*, each formed e.g. by felt. The upper limit stoppers 6*a* are attached to a lower surface of the chassis 2, while the lower limit stoppers 6*b* are attached to an upper surface of the chassis 2. Hammers 4 are pivotally supported by a support shaft 4*a* on the chassis 2. An actuator portion 3*g* of the key 3 is in abutment with a portion of an associated one of the hammers 4 forward of the support shaft 4*a*, from above. Further, the chassis 2 has a large number of key switches 7 (only one of which is shown) provided under the hammer 4, for detecting information of depression of each key 3.

Due to the construction described above, in the keyboard device 40, when any of the keys 3 is depressed from a key-off state shown in FIG. 6, the key 3 is pivotally moved downward about the associated key fulcrum 5. Then, when the lower surface of the key 3 is brought into abutment with the associated lower limit stopper 6*b*, the pivotal motion of the key 3 is stopped by the stopper 6*b* while alleviating the impact of collision of the key 3. The hammer 4 is pivotally moved in the anticlockwise direction as viewed in FIG. 6 by being urged via the actuator portion 3*g* of the key 3. In accordance with the pivotal motion of the hammer 4, the key switch 7 associated with the key 3 is pressed by the hammer 4 whereby depression of the key 3 and a speed of the depression are detected by the key switch 7. Generation of a tone is controlled based on the result of the detection. On the other hand, when released, the key 3 is pivotally moved upward about the key fulcrum 5 by the urging force of the spring 12 to thereby bring the engaging portions 3*f*, 3*f* into abutment with the associated upper limit stopper 6*a*. Thus, the key 3 is returned to the key-off state.

However, the conventional keyboard device 40 described above suffers from the following problems: In the keyboard device 40, since the keys 3 are open downward, when the depressed key 3 is brought into abutment with the lower limit stopper 6*b*, lower ends of the left and right side walls 3*d*, 3*d* are abutted against the lower limit stopper 6*b*, and hence the key 3 has very small abutment areas via which it is abutted against the stopper 6*b*. This means that the lower ends of the left and right side walls 3*d*, 3*d* press downward the lower limit stopper 6*b*, formed by felt, with load concentrated on the very small abutment areas. Therefore, as shown in FIG. 7, the lower ends of the left and right side walls 3*d*, 3*d* bite the lower limit stopper 6*b* to thereby largely deform the abutment portion in a manner sinking the same. The pivotal motion of the key 3 is not terminated immediately after the abutment, and continues during a certain time period until the deformation of the lower limit stopper 6*b* reaches a limit. As a result, when the key 3 is depressed, it is difficult to obtain a feeling (stop feeling) that the key 3 is stopped at a predetermined position. This adversely affects the key touch feeling.

Further, as described above, since the amount of deformation of the lower limit stopper 6*b* is large, plastic deformation is liable to occur, and it is difficult to restore the deformed stopper 6*b* to its original shape even after the pressed stopper 6*b* is released. This results in degraded durability of the lower limit stopper 6*b*, for example, causing deviation of abutting timing in which the key 3 is brought into abutment with the associated stopper 6*b*.

SUMMARY OF THE INVENTION

It is an object of the invention to provide a keyboard device for a keyboard musical instrument, which is capable of enhancing the key touch feeling sensed when each key is depressed, and durability of stoppers.

To attain the above object, the present invention provides a keyboard device for a keyboard musical instrument, comprising:

keys each opening downward, and having side walls, and an abutment portion provided inside the side walls, the abutment portion having a lower end located at approximately the same height as lower ends of the side walls, the keys each performing pivotal downward motion when depressed; and stoppers arranged under the keys in a manner associated therewith, respectively, for abutment of the side walls and the abutment portion of an associated one of the keys thereagainst, thereby stopping the downward pivotal motion of the associated key, the stoppers having a shock-absorbing property.

According to this keyboard device, each key performs downward pivotal motion when it is depressed, and brought into abutment with the associated stopper, whereby the pivotal motion of the key is stopped. Further, an abutment portion is provided inside the side walls of the key opening downward. The abutment portion has an lower end located at approximately the same height as the lower ends of the side walls of the associated key. Therefore, when the key is depressed for pivotal motion, the lower ends of the side walls and the lower end of the abutment portion are simultaneously brought into abutment with the associated stopper provided thereunder. Due to the abutment of the lower end of the abutment portion against the stopper in addition to that of the lower ends of the side walls, there is an increase in the abutment area of the key via which it is abutted against, i.e. collides with the stopper, compared with the conventional device, causing dispersion of load applied from the key to the stopper. In other words, load per unit area applied to the stopper is reduced. As a result, the amount of biting of the key on the stopper due to the load applied to the stopper via the key is reduced, whereby the amount of deformation of the stopper is reduced, immediately terminating the pivotal motion of the key upon abutment of the key against the stopper. This makes it possible to positively have the stop feeling of the key when it is depressed, thereby making it possible to enhance the key touch feeling. Further, since the stoppers are not largely deformed, plastic deformation is hard to be caused, which makes it possible to enhance durability of the stoppers.

Preferably, the abutment portion is formed by at least one rib.

According to this preferred embodiment, since the rib of a key is brought into abutment with the associated stopper under the key, the abutment area of the key is increased, whereby it is possible to disperse load applied from the key to the stopper. Further, since the abutment portion is formed by such a member simple in shape as a rib, it can be formed with ease, thereby making it possible to prevent increases in the number of man-hours and manufacturing costs. Further, since the increase in the weight of the key caused by provision of the rib is slight, it has almost no adverse influence on the key touch feeling sensed when the key is depressed.

More preferably, the rib is formed by a plate-shaped rib having a lower surface extending along a plane including lower end faces of the side walls.

According to this preferred embodiment, the rib is plate-shaped, and has a lower surface extending along a plane including lower end faces of the side walls of the key. Therefore, when the key is depressed, not only the lower end faces of the side walls but also the lower surface of the rib is brought into abutment with the stopper. That is, since the key is brought into abutment with the stopper via such a large abutment area, the load applied from the key to the stopper is further dispersed. As a result, the amount of deformation of the stopper is largely reduced, whereby it is possible to further enhance the durability of the stoppers.

More preferably, the keys are formed by synthetic resin molded articles in which each key is integrally molded with the rib.

According to this preferred embodiment, the keys and the ribs can be easily made inexpensively e.g. by injection molding.

Further preferably, the lower end face of the rib is flush with the lower end faces of the side walls.

The above and other objects, features, and advantages of the invention will become more apparent from the following detailed description taken in conjunction with the accompanying drawings.

DETAILED DESCRIPTION OF THE PREFERRED EMBODIMENTS

Figure 1:
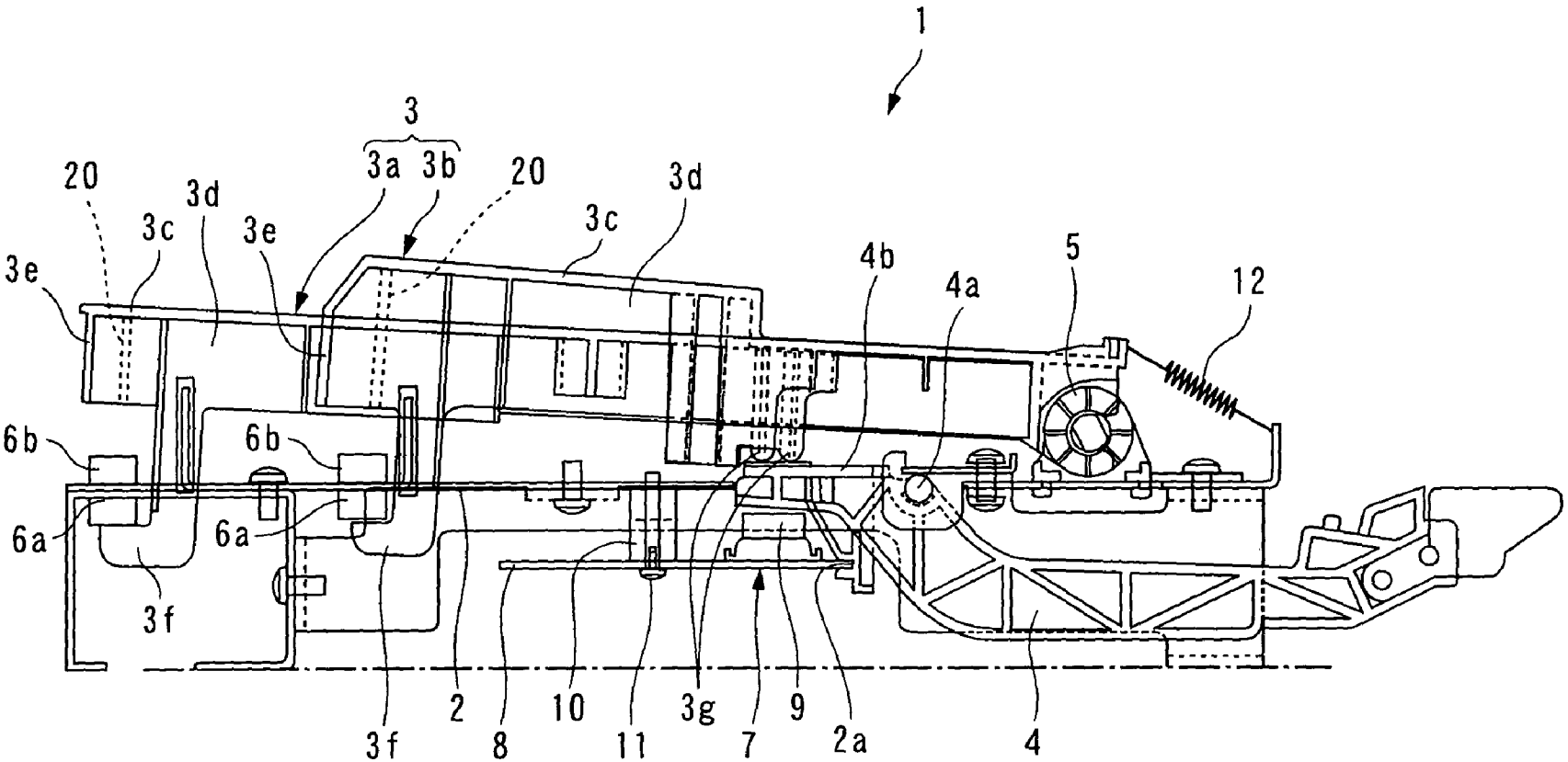
FIG. 1 is a side view of a keyboard device for an electronic piano, to which is applied the present invention.

The invention will now be described in detail with reference to the drawings showing a preferred embodiment thereof. Referring first to FIG. 1, there is shown a keyboard device for an electronic piano, according to an embodiment of the invention. The keyboard device 1 has the same basic construction as that of the conventional keyboard device 40 described hereinabove, and is distinguished from the same only in the configuration of keys 3. Therefore, in the following description, component elements other than the keys 3 are designated by the same reference numerals as used in the description of the conventional keyboard device 42.

The keyboard device 1 includes a chassis 2, a large number of keys 3 (one of white keys 3*a* and one of black keys 3*b* are shown in FIG. 1) mounted on the chassis 2 in a state arranged side by side in the left-right direction (in the direction of the reverse side of a sheet on which FIG. 1 is illustrated), as viewed in FIG. 1, a large number of hammers 4 (only one of which is shown) pivotally moved along with depression of the respective associated keys 3, and so forth.

The keys 3, which are comprised of the white keys 3*a* and the black keys 3*b*, are formed by synthetic resin molded articles, respectively. Each key 3 has a top wall 3*c*, left and right side walls 3*d*, 3*d* (only one of which is shown) and a front wall 3*e*, and is open downward. Further, each key 3 has a rear end thereof pivotally supported by a key fulcrum 5 provided on the chassis 2. Disposed between the rear end of the key 3 and the chassis 2 is a spring 12 for biasing the key 3 in the direction of release thereof (in the clockwise direction, as viewed in FIG. 1).

Figure 2:
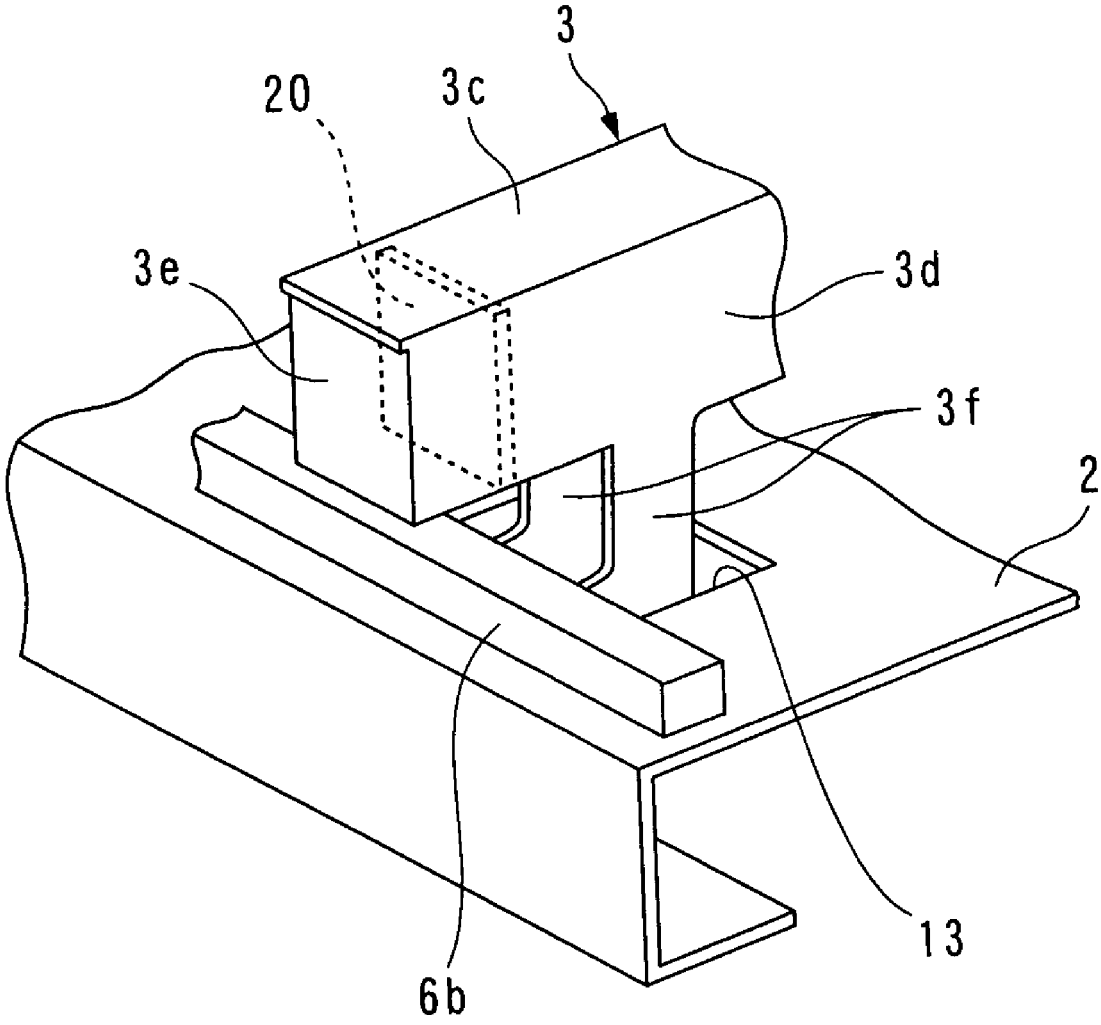
FIG. 2 is a perspective view of a front end of a key, a stopper, and so forth.
Figure 3:
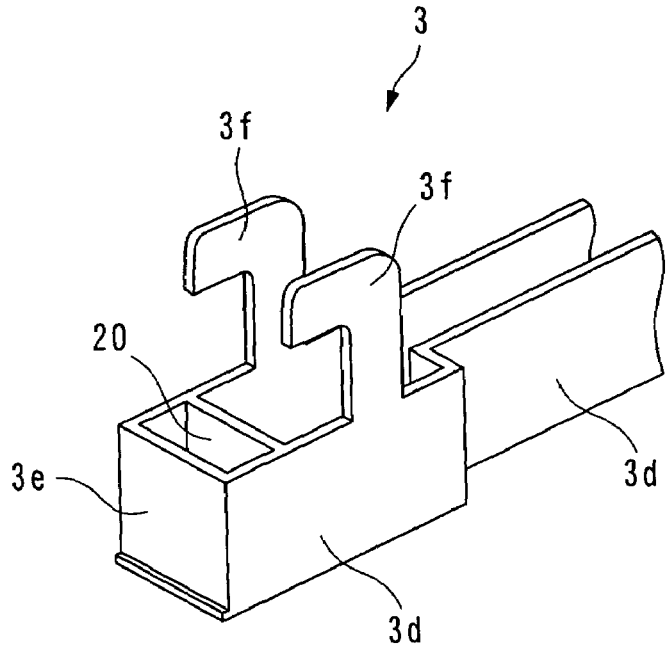
FIG. 3 is a perspective view of the front end of the key, as viewed from the lower surface side of the key.

Referring to FIGS. 2 and 3, each key 3 has a rib 20 (abutment portion) formed in the inside of a front end thereof. When the key 3 is made, the rib 20 is simultaneously and integrally molded with the key 3 e.g. by injection molding. The rib 20 is in the form of a plate, and has approximately the same thickness as that of the side wall 3*d*. Further, the rib 20 is disposed in parallel with the front wall 3*e* at a location backward of the front wall 3*e* with a predetermined distance therefrom. The rib 20 has an upper end extending up to the top wall 3*c*, and a left end and a right end extending to the left and right side walls 3*d*, 3*d*, respectively, that is, integrally formed with the walls 3*c*, 3*d*, 3*d*. Further, the rib 20 has a lower end flush with the lower ends of the side walls 3*d*, 3*d*.

The chassis 2 has upper limit stoppers 6*a*, and lower limit stoppers 6*b* (stoppers) arranged thereon. The upper and lower limit stoppers 6*a*, 6*b* are formed by a material, such as felt, which has a shock-absorbing property, and extend in the left-right or longitudinal direction such that all the keys 3 can be stopped thereby, that is, the white keys 3*a* can to stopped by one pair of an upper limit stopper 6*a* and a lower limit stopper 6*b* and the black keys 3*b* can be stopped by the other pair of an upper limit stopper 6*a* and a lower limit stopper 6*b*. The lower limit stoppers 6*b* are attached to front end portions of an upper surface of the chassis 2 at locations corresponding to the ribs 20 of the white keys 3*a* and black keys 3*b*. The upper limit stoppers 6*a* are mounted on the lower surface of the chassis 2 at respective locations just under the associated lower limit stoppers 6*b* provided on the upper surface of the chassis 2, such that the upper and lower limit stoppers 6*a*, 6*b* sandwich the chassis 2.

Figure 4A:
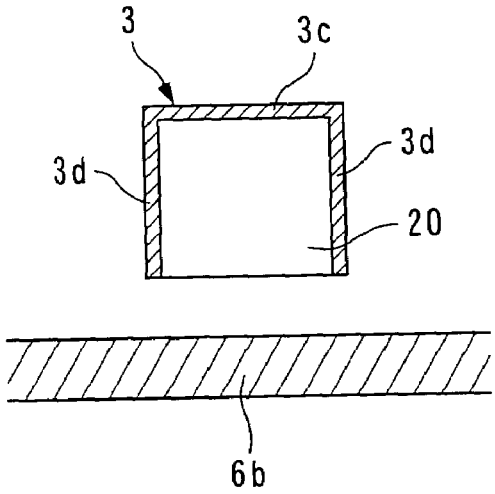
FIG. 4A is a diagram schematically showing a key-off state of the key.

L-shaped engaging portions 3*f*, 3*f* extend downward from respective portions of the left and right side walls 3*d*, 3*d* rearward of the rib 20 at the front end of each key 3. Similarly to the rib 20, the engaging portions 3*f*, 3*f* are also integrally molded with the key 3 when the key 3 is made. The engaging portions 3*f*, 3*f* extend downward through a guide hole 13 formed in the chassis 2 into the lower side of the chassis 2. When the key 3 is released, the engaging portions 3*f*, 3*f* are brought into abutment with the upper limit stopper 6*a* associated with the key 3, whereby the key 3 is held in a key-off state shown in FIG. 1 and FIG. 4A.

Each of the hammers 4 is supported by the chassis 2 at a location below the associated key 3 such that it is pivotal about a support shaft 4*a* at a front end thereof. Further, an actuator portion 3*g* of the associated key 3 is in abutment from above with an actuator-abutting portion 4*b* of the hammer 4 forward of the support shaft 4*a*. A portion of the hammer 4 rearward of the support shaft 4*a* extends rearward below the chassis 2 over a long distance. At a location above a rear end of the hammer 4, there is disposed a hammer stopper, not shown, for restricting an upward pivotal motion of the hammer 4.

The chassis 2 is formed with a large number of key switches 7 (only one of which is shown) for detecting the information of depression of the keys 3, at respective locations under the actuator-abutting portions 4*b* of the hammers 4 associated with the keys 3. Each key switch 7 is comprised of a printed circuit board 8, and a switch body 9 which is formed by a rubber switch and attached to the printed circuit board 8 in association with each key 3. Further, the key switch 7 is mounted to the chassis 2 by screws 11 via a spacer 10, with a rear end portion of the printed circuit board 8 being inserted into an engaging recess 2*a* formed in the chassis 2.

Figure 4B:
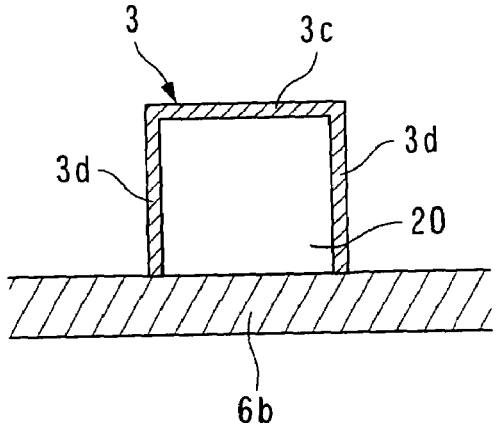
FIG. 4B is a diagram schematically showing a state of the key being in abutment with a stopper.

Due to the construction described above, in the keyboard device 1, when one of the keys 3 is depressed from a key-off state thereof, the key 3 is pivotally moved downward about the associated key fulcrum 5. Then, the lower ends of the side walls 3*d*, 3*d* and that of the rib 20 of the key 3 are simultaneously brought into abutment with the lower limit stopper 6*b* (as shown in FIG. 4B), whereby the pivotal motion of the key 3 is stopped to reduce an impact generated by the abutment or collision of the key 3.

Further, a hammer 4 associated with the key 3 is pivotally moved in the anticlockwise direction as viewed in FIG. 1 by being urged via the actuator portion 3*g* of the key 3 and the actuator-abutting portion 4*b* of the hammer 4. In accordance with the pivotal motion of the hammer 4, the associated key switch 7 is urged by the lower surface of the actuator-abutting portion 4*b* of the hammer 4, whereby depression of the key 3 and a speed of the depression are detected, and generation of a tone is controlled based on the result of the detection.

On the other hand, when the key 3 is released, it is pivotally moved upward about the key fulcrum 5 by the biasing force of the spring 12 to thereby bring the engaging portions 3*f*, 3*f* into abutment with the upper limit stopper 6*a*, whereby the key 3 is returned to the key-off state. Accordingly, the hammer 4 as well is returned to the key-off state due to its own weight.

As described above, according to the keyboard device 1 of the present embodiment, each key 3 has not only the lower ends of the side walls 3*d*, 3*d* but also that of the rib 20 brought into abutment with the lower limit stopper 6*b*, and hence the area of portions (abutment area) via which the key 3 is brought into abutment with the lower limit stopper 6*b* is increased compared with the conventional device. This disperses load applied from the key 3 to the lower limit stopper 6*b*. More specifically, load per unit area applied to the lower limit stopper 6*b* is reduced. As a result, biting of the key 3 on the lower limit stopper 6*b* due to the load applied to the stopper 6*b* is alleviated, whereby the amount of deformation of the stopper 6*b* is reduced. Therefore, the pivotal motion of the key 3 is immediately terminated after the key 3 has been brought into abutment with the lower limit stopper 6*b*, which makes it possible to positively have the stop feeling of the key 3 when it is depressed. This makes it possible to enhance the key touch feeling. Further, since the lower limit stopper 6*b* undergoes little deformation, plastic deformation is hard to occur. This makes it possible to enhance durability of the lower limit stopper 6*b*.

Further, since the rib 20 is simple in shape, it can be easily molded inexpensively, which makes it possible to prevent increases in the number of man-hours and manufacturing costs. Further, since the increase in the weight of the key 3 caused by provision of the rib 20 is slight, it has almost no adverse influence on the touch feeling of key 3 when it is depressed.

FIGS. 5A to 5F show variations of the key 3 of the keyboard device 1, respectively. The variations are distinguished from the FIG. 3 key only in the construction of the rib 20. In the following, descriptions are given of the variations of the key 3 respectively.

Figure 5A:
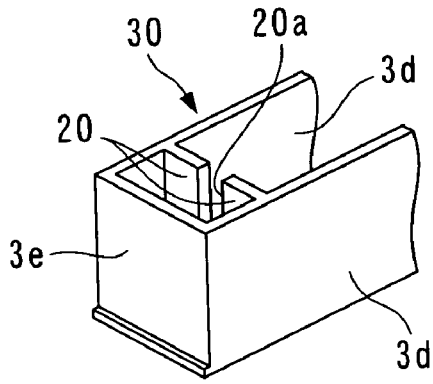
FIGS. 5A to 5F are respective perspective views of variations of the key, as viewed from the lower surface side of the key.

A key 30 shown in FIG. 5A has a rib 20*a* distinguished from the FIG. 3 rib 20 in that it is formed with a slit 20*a* vertically extending up to the top wall 3*c*, in an intermediate portion thereof in the left-right direction. Due to this construction, the area of portions via which the key 30 is brought into abutment with the lower limit stopper 6*b* is also increased compared with the conventional device, and hence it is possible to obtain the same advantageous effects as provided by the key 3 described above.

Figure 5B:
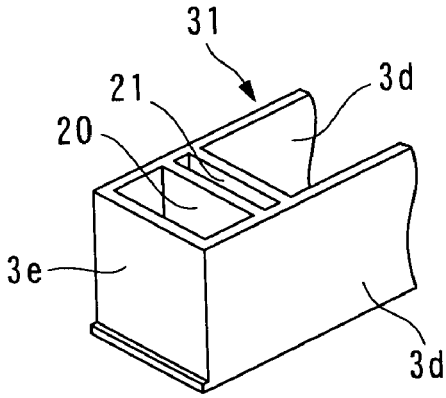

A key 31 shown in FIG. 5B has, in addition to the FIG. 3 rib 20, a rib 21 (abutment portion) having the same construction as that of the FIG. 3 rib 20, disposed behind the rib 20 in parallel therewith. More specifically, the two ribs 20, 21 are arranged side by side with a predetermined small distance therebetween in the front-rear direction. This makes it possible to cause the key 31 to have an increased rigidity. Further, the two ribs 20, 21 are arranged such that a center therebetween in the front-rear direction coincides with a center of the lower limit stopper 6*b* in the front-rear direction. As a result, the abutment area of the key 31 via which the key 31 is brought into abutment with the lower limit stopper 6*b* during depression of the key 31 is increased by the abutment area of the rib 21, and the side walls 3*d*, 3*d* extending in the front-rear direction and the ribs 20, 21 extending in the left-right or lateral direction are brought into abutment with the lower limit stopper 6*b* in a well-balanced manner to thereby disperse the load applied to the lower limit stopper 6*b* in a properly-balanced manner. This makes it possible to obtain the effects provided by the case of the key 3 described above in a more advantageous fashion.

Figure 5C:
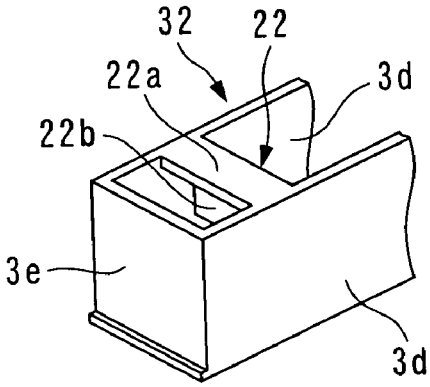

In a key 32 shown in FIG. 5C, the FIG. 3 rib 20 is replaced by a rib 22 (abutment portion) which is L-shaped in cross section and comprised of a horizontal portion 22*a* and a vertical portion 22*b*. The horizontal portion 22*a* horizontally extends between the left and right side walls 3*d*, 3*d*, along a plane including the lower ends of the side walls 3*d*, 3*d*, with a lower surface thereof being flush with the lower ends of the side walls 3*d*, 3*d*. Further, the horizontal portion 22*a* is disposed such that a center thereof in the front-rear direction coincides with the center of the lower limit stopper 6*b* in the front-rear direction. The vertical portion 22*b* vertically extends from a rear end of the horizontal portion 22*a* to vertically intermediate portions of the side walls 3*d*, 3*d*. Due to the construction described above, when the key 32 is depressed, the lower ends of the side walls 3*d*, 3*d*, and the entire lower surface of the horizontal portion 22*a* are brought into abutment with the lower limit stopper 6*b*. As described above, since the key 32 having a large abutment area is abutted against the lower limit stopper 6*b*, the load applied to the stopper 6*b* is dispersed more effectively. Therefore, the amount of deformation of the lower limit stopper 6*b* can be largely reduced, whereby it is possible to obtain the effects provided by the case of the key 3 described above, in a more advantageous fashion.

Figure 5D:
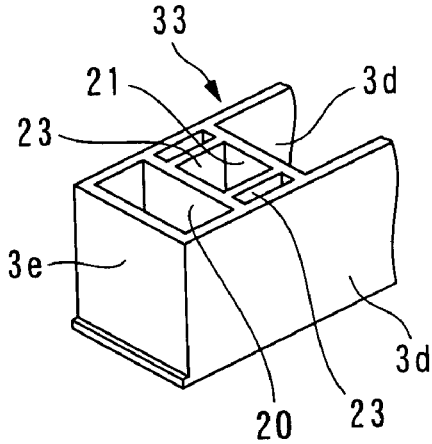

A key 33 shown in FIG. 5D is distinguished from the FIG. 5B key 31 in that a rib 21 is disposed at a location rearward of the rib 21 of the FIG. 5B key 31 to increase the distance between the ribs 20, 21, and two plate-shaped longitudinal ribs 23, 23 (abutment portion) are provided for connecting the ribs 20, 21. The longitudinal ribs 23, 23 vertically extend in parallel with each other from lower ends of the ribs 20, 21 to the top wall 3*c*. This makes it possible to cause the key 33 to have an increased rigidity. Further, the abutment area of the key 33 via which the key 33 is brought into abutment with the lower limit stopper 6*b* during depression of the key 33 is increased by the abutment areas of the two longitudinal ribs 23, 23, and a combination of the ribs 20, 21 extending in the lateral direction and the longitudinal ribs 23, 23 extending in the front-rear direction disperses the load applied to the lower limit stopper 6*b* in a more properly-balanced manner, whereby it is possible to obtain the effects provided by the key 3 described above, in a more advantageous fashion.

Figure 5E:
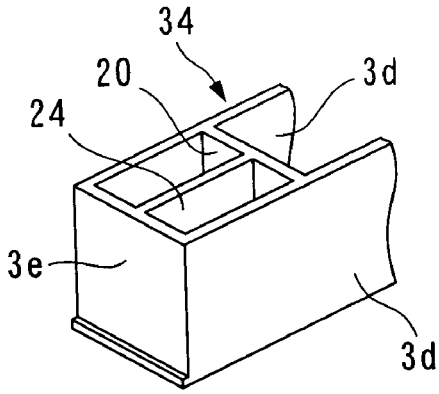

A key 34 shown in FIG. 5E is distinguished from the FIG. 3 key 3 in that a rib 20 is disposed at a more reward location than the rib 20 of the key 3, to increase the distance between the front wall 3*e* and the rib 20 and a plate-shaped longitudinal rib 24 (abutment portion) are provided for connecting respective intermediate portions of the front wall 3*e* and the rib 20 in the left-right direction. This increases the rigidity of the key 34. Further, the rib 20 is disposed such that a center thereof in the front-rear direction coincides with the center of the lower limit stopper 6*b* in the front-rear direction. Due to the above configuration of the key 34, when the key 34 is depressed, a lower end of the longitudinal rib 24 is brought into abutment with the lower limit stopper 6*b* at a location close to the center of the rib 20 in the left-right direction. This makes it possible to further, although with a slight advantage, disperse the load applied to the lower limit stopper 6*b*, whereby it is possible to obtain the effects provided by the case of the key 3 described above, in a more advantageous fashion.

Figure 5F:
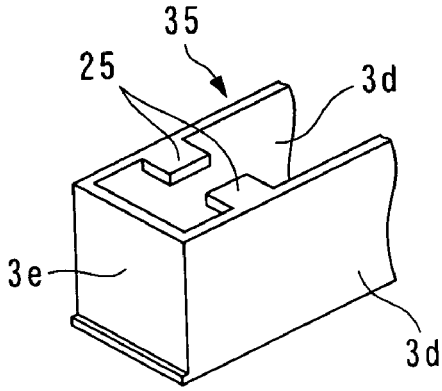
Figure 6:
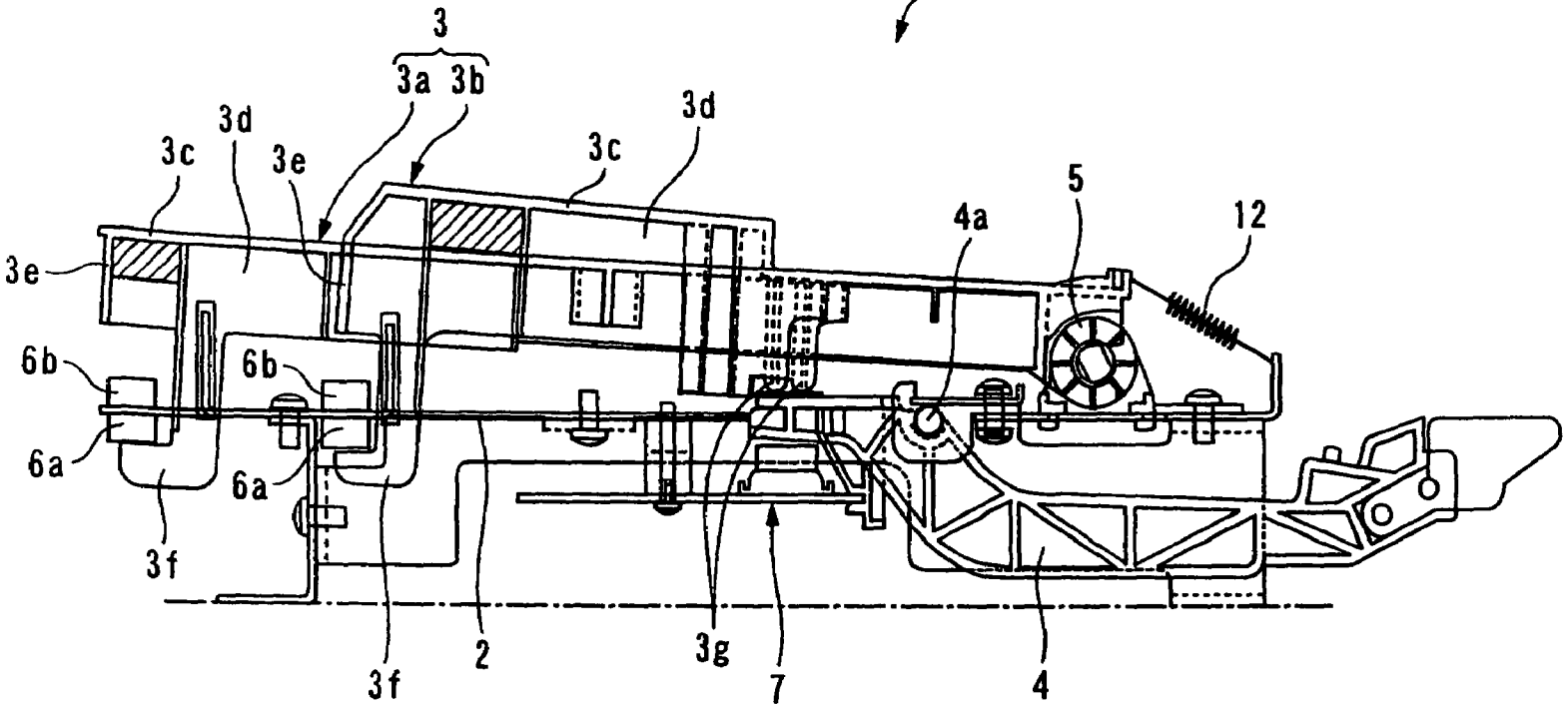
FIG. 6 is a side view of a conventional keyboard device for an electronic piano.
Figure 7:
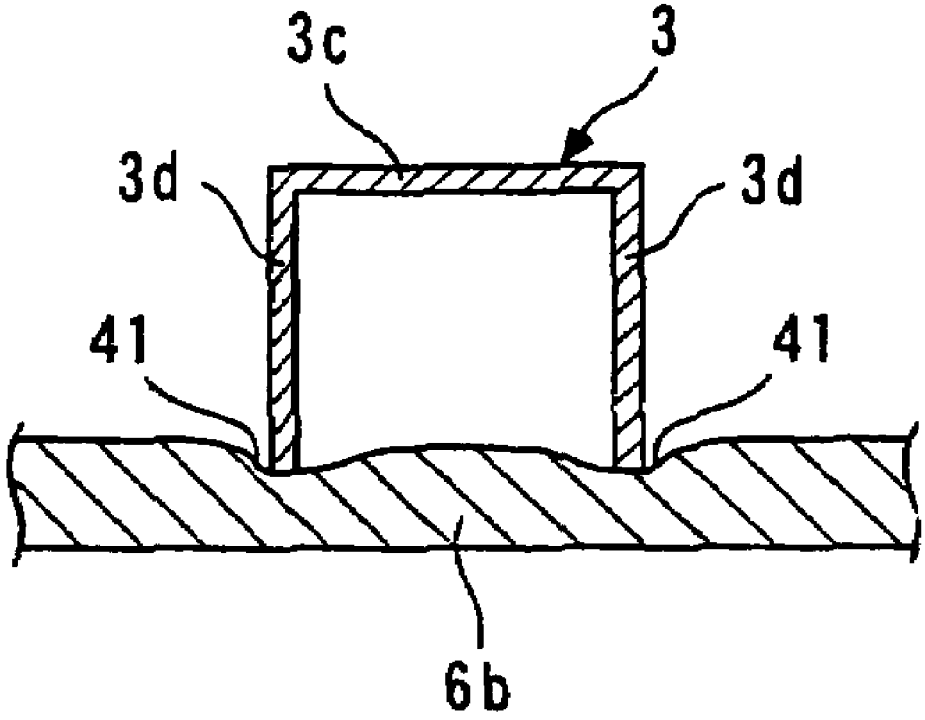
FIG. 7 is a diagram schematically showing a state of a conventional key being in abutment with a stopper.

A key 35 shown in FIG. 5F is distinguished from the key 3 shown in FIG. 3 in that the rib 20 is replaced by a pair of left and right plate-shaped ribs 25, 25 (abutment portion) horizontally-extending from the side walls 3*d*, 3*d*, in a manner opposed to each other. A gap is formed between the ribs 25, 25. When the key 35 is depressed, the lower ends of the side walls 3*d*, 3*d*, and the entire lower surfaces of the ribs 25 are brought into abutment with the lower limit stopper 6*b*. As described above, although the key 35 is made simpler in construction than the key 32, the key 35 can be abutted against the lower limit stopper 6*b* via the large abutment area. Further, it is possible to manufacture the key 35 more easily and obtain approximately the same advantageous effects provided by the key 32.

Although in the above described embodiment and variations, various types of plate-shaped ribs 20 to 25 are provided for being brought into abutment with the lower limit stopper 6*b*, for thereby dispersing the load applied to the lower limit stopper 6*b*, the shapes and number of ribs are not limited to those of the illustrated examples, but they can be configured freely so long as the weight of the key 3 is not largely changed. Further, although the above described embodiment and variations are examples of application of the present invention to the keyboard device for the electronic piano, this is not limitative, but it is possible to apply the present invention to keyboard devices of all kinds which use keys open downward, and stoppers having a shock-absorbing property for stopping pivotal motions of the keys.

It is further understood by those skilled in the art that the foregoing are preferred embodiments of the invention, and that various changes and modifications may be made without departing from the spirit and scope thereof.

What is claimed is:

1. A keyboard device for a keyboard musical instrument, comprising:

keys each opening downward, and having a first side wall, a second side wall, and a front wall, and an abutment portion provided inside said side walls and formed inside of the front wall of said keys, said abutment portion having a lower end located at the same height as lower ends of said side walls, said keys each performing pivotal downward motion when depressed; and stoppers arranged under said keys in a manner associated therewith, respectively, for abutment of said side walls and said abutment portion of an associated one of said keys thereagainst, thereby stopping the downward pivotal motion of said associated key, said stoppers having a shock-absorbing property, wherein said abutment portion is at least one unitary plate-shaped rib continuously extending from the first side wall to the second side wall and having a flat lower surface extending coplanar to a plane including lower end faces of said side walls and wherein the coplanar flat lower surface of the unitary plate-shaped rib includes a largest surface area of the plate-shaped rib, and coming into surface abutment with said stoppers.

2. A keyboard device as claimed in claim 1, wherein said keys are formed by synthetic resin molded articles in which each key is integrally molded with said rib.

* * * * *